US009682467B2

(12) United States Patent
Harrison

(10) Patent No.: US 9,682,467 B2
(45) Date of Patent: Jun. 20, 2017

(54) NAIL-DRIVING HAMMER

(71) Applicant: Raymond Anthony Harrison, Vancouver (CA)

(72) Inventor: Raymond Anthony Harrison, Vancouver (CA)

( * ) Notice: Subject to any disclaimer, the term of this patent is extended or adjusted under 35 U.S.C. 154(b) by 90 days.

(21) Appl. No.: 14/185,598

(22) Filed: Feb. 20, 2014

(65) Prior Publication Data

US 2017/0001292 A1 Jan. 5, 2017

(51) Int. Cl.

| | |
|---|---|
| ***B25D 1/14*** | (2006.01) |
| ***B25D 1/06*** | (2006.01) |
| ***B25G 1/10*** | (2006.01) |
| ***B25D 1/04*** | (2006.01) |

(52) U.S. Cl.

CPC ..... *B25D 1/14* (2013.01); *B25D 1/04* (2013.01); *B25D 1/06* (2013.01); *B25G 1/102* (2013.01)

(58) Field of Classification Search

CPC . B25D 1/005; B25D 1/06; B25D 1/04; B25D 1/14; B25G 1/102; B25G 1/10

USPC ..... 7/143, 146, 147; 81/23, 24, 26, 44, 55

See application file for complete search history.

(56) References Cited

U.S. PATENT DOCUMENTS 29,760 A * 8/1860 Boeklen ..... B25D 1/06 7/901
63,106 A * 3/1867 Selsor ..... B25D 1/04 81/23
303,230 A * 8/1884 Niebel ..... B25D 1/04 81/23
392,515 A * 11/1888 Hoover ..... B25D 1/04 81/23
506,935 A * 10/1893 Potts ..... B25D 1/00 7/146
812,947 A * 2/1906 Molkenthin ..... B25D 1/04 7/147
2,597,876 A * 5/1952 Kurkjian ..... B25D 1/06 7/143
3,796,244 A * 3/1974 Florian ..... B25D 1/00 81/26
3,987,828 A * 10/1976 Matheis ..... B25D 1/06 7/146
4,193,433 A * 3/1980 Sickler ..... B25D 1/04 81/23
4,273,172 A * 6/1981 Hoosier ..... B25D 1/04 81/23
4,367,778 A * 1/1983 Bradbury ..... B25D 1/04 81/21

(Continued)

FOREIGN PATENT DOCUMENTS

FR 1335243 A * 8/1963 ..... B25D 1/06

*Primary Examiner* — Joseph J Hail
*Assistant Examiner* — Tyrone V Hall, Jr.

(57) ABSTRACT

The present invention is a manual nailing tool configured to provide a user with improved functional advantages over prior art hammers. It manually drives a substantial or predetermined amount of a fastener, such as an 8.89 cm (3½ inch) common nail, into a work piece with one hand using one striking action. The unique configuration of the integrally formed nail-starter and angled strike face closely combines the nail-starter function with a full force, sustained first strike on the nail head. The hammer is also configured with a unique head shape and strike face to improve striking power and facilitate a stronger and more direct impact force on the nail head.

9 Claims, 16 Drawing Sheets

(56) References Cited

U.S. PATENT DOCUMENTS

| | | | | | |
|---|---|---|---|---|---|
| 4,465,115 | A * | 8/1984 | Palomera | B25D 1/06 | 81/24 |
| 5,027,677 | A * | 7/1991 | Rallo | B25D 1/00 | 81/20 |
| 5,988,020 | A * | 11/1999 | Johnson | B25D 1/06 | 81/23 |
| 6,301,996 | B1 * | 10/2001 | Crawford | B25D 1/06 | 81/23 |
| 6,339,974 | B1 * | 1/2002 | Kotschner | B25D 1/06 | 81/23 |
| 6,829,966 | B1 * | 12/2004 | Bramuchi | B25D 1/04 | 81/23 |
| 2003/0089203 | A1 * | 5/2003 | Wu | B25D 1/02 | 81/24 |
| 2005/0115365 | A1 * | 6/2005 | Nau | B25D 1/14 | 81/26 |
| 2007/0089571 | A1 * | 4/2007 | Chen | B25D 1/045 | 81/23 |
| 2010/0116096 | A1 * | 5/2010 | Hanlon | B25D 1/12 | 81/22 |
| 2011/0314971 | A1 * | 12/2011 | Nicosia | B25D 1/04 | 81/24 |

* cited by examiner

SECTION A-A

SECTION B-B

SECTION C-C

SECTION D-D

NAIL-DRIVING HAMMER

FIELD OF INVENTION

The present invention relates to hammers, and more particularly to a hammer with a unique head shape and improved one-handed nailing configuration.

BACKGROUND

Conventional hammers typically include a head and a handle. During use, a strike surface disposed on the head of the hammer is configured to strike against an object, such as a nail. Placing the nail with fewer strikes, with fewer failures, less concussive vibration and less energy output from the user are some objectives of hammer makers.

The common use of nail-starters on hammers has partially overcome the problem of requiring two hands to start a nail and hence removed some of the risk of injury to fingers. Many available hammers have a nail-starter located on the top front portion of the head. A lateral groove, configured to a length of at least 3.5 cm (1⅜ in.) from bell face to partial nail starter face, with a recessed magnet that retains the nail shank. The nail head rests in a generally rounded opening with a gradually sloping partial strike face that extends upward, supporting only a portion of the common nail head. This partial strike face is constructed so as to apply a limited amount of force to the nail head before the nail slides out from the nail head opening and loses contact. Hence the nail shaft is implanted to a shallow depth within the work piece surface. It is an acceptable, but not a consistently reliable means of nail starting and this is perhaps why it often referred to as an optional hammer feature, (eg., U.S. Pat. No. 8,047,099 B2) which states: The nail starter arrangement that includes the groove 64, magnet 67, and the surface 69 are optional.

There are a number of prior art nailing tools that have approached the problem of placing a nail that has been retained by the hammer. One technique, used in U.S. Pat. No. 5,894,764, confines and therefore restricts the nail head movement with both a vertical and horizontal wall and is only capable of a placing the nail to limited depth in a work piece. This typifies the fixed nail head nail starter method, whereby any nail depth placement in the work piece more than a minimal amount can result in a bent head, bent nail shaft or misdirected nail shaft. There are a number of limited nail starter methods and tools available, including commonly available nail-starters disposed on typical nailing hammers. Some relevant prior art that employ typical and alternate methods are:

Pat. US 20110314971 A1
Which incorporates a nail magazine and mechanism to deliver nails.

U.S. Pat. No. 4,273,172 A
Which offers a limited force strike with a restricted nail head.

U.S. Pat. No. 2,597,876 A
Which offers a fixed head holder and limited depth placement of the shaft.

U.S. Pat. No. 4,193,433 A
Which retains the nail head with a hook beneath claw and offers limited nail shaft depth.

U.S. Pat. No. 6,301,996 B1
Which offers a limited depth with a multiple angle restriction upon the nail head.

These methods either confine and restrict the nail head or deliver a limited glancing strike. If the nail head is restricted the friction and forces that act upon the nail head cause it to be misdirected or cause the nail shaft to bend. The limited glancing strike of the typical partial strike face nail-starters can only drive the nail shaft in to a limited depth. These nail-starters are configured with only a limited amount of weight directly behind the partial nail head strike face.

When using the typical integrally formed nail-starter, the second strike, after initially planting the nail, is critical. The shallow depth of the initial nail start makes the successive strike, usually the most forceful, also the most likely to produce failure. This second blow requires more skill and accuracy to ensure an acceptable continuation of the nail placement, sometimes resulting in bent nail shafts or nails completely ejected from the work piece. If the second strike is successful it is commonly followed by a number of additional strikes, each one having a level of difficulty and having the possibility of bending or misdirecting the nail. The total number of strikes required is usually between 4 and 6, depending on, among other factors, nail size and desired depth.

Magnetic face specialty tools, usually referred to as tack hammers, roof paper hammers or upholstering hammers, have existed for more than one hundred years. These tools require specialized fasteners that typically have one or more of the following attributes; sharper points, shorter shafts, reinforced heads and/or oversized heads. Some prior art examples of tack hammers are as follows:

Magnetic tack-hammer U.S. Pat. No. 840,441 A
Magnetic tack-hammer U.S. Pat. No. 710,615 A
Tack hammer U.S. Pat. No. 2,433,223 A
Nail or tack holding attachment for hammers U.S. Pat. No. 469,710 A
Magnetic roofing hammer U.S. Pat. No. 20030140734 A1
Coil Nailer U.S. Pat. No. 20110049215 A1

Nail length is also an issue with typical nail starters. In order to function the nail length must be greater than the distance from the nail-starter strike face to the hammer strike face. Typically nails shorter than 3.8 cm (1½ in.) cannot utilize the common bell head nail starter.

Another problem with commonly used hammers is that they require a multitude of strikes in order to place the nail in a surface to a predetermined depth. Typically, said depth is more than 80 percent of the nail shaft length. Transporting the hammer weight in an arcing motion for a multitude of strikes in order to achieve this depth causes muscle stress and fatigue in the user.

An additional problem with repeated hammer face to nail head strikes is twist and vibration. Common hammer handles have a tendency to transfer torque (the twisting across the longitudinal axis of the handle) and kinetic energy caused by metal impacting metal to the user when a nail head is struck. This problem is compounded by the fact that the most control is required at the moment of impact between hammer face and nail head. The user must grip the handle the tightest at that time. This is when the most kinetic energy and twist occur within the handle, creating faster fatigue and adding more muscle stress to the user.

The following is a list of relevant prior art:

U.S. Pat. No. 20120036965 A1
U.S. Pat. No. 7,404,346 B2
U.S. Pat. No. 4,667,747 A
U.S. Pat. No. 3,788,373 A
EP Pat. No. 2517837 A2

This embodiment of the present invention overcomes these problems by combining the nail-start strike and first full strike into one continuous action. Among other factors, it is the freedom of movement between nail head and striking surface afforded by the present invention which thereby allows the nail to be struck with full force. The nail shaft and nail head remain in their original uniform configuration and transverse directly into the work piece. Hence the nail is placed more consistently, with more reliability and with fewer strikes. Since there are fewer strikes required, and commonly only two metal on metal strikes, there is less energy output from the user and less concussive vibration.

This embodiment of the present invention is also configured with the preferred distance of 15 mm (⅝ in.) from the front edge, (horizontal cylinder segment strike-face), to the nail-starter strike face. Therefore, said embodiment provides a means for placing any nails minimally longer than 15 mm (⅝ in.). The 15 mm horizontal cylinder segment also provides a means to place nails in one strike to a depth whereby 15 mm of the nail is all that remains above the work piece surface.

These and other advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

FIGURE REFERENCE NUMERALS

Figure 1:
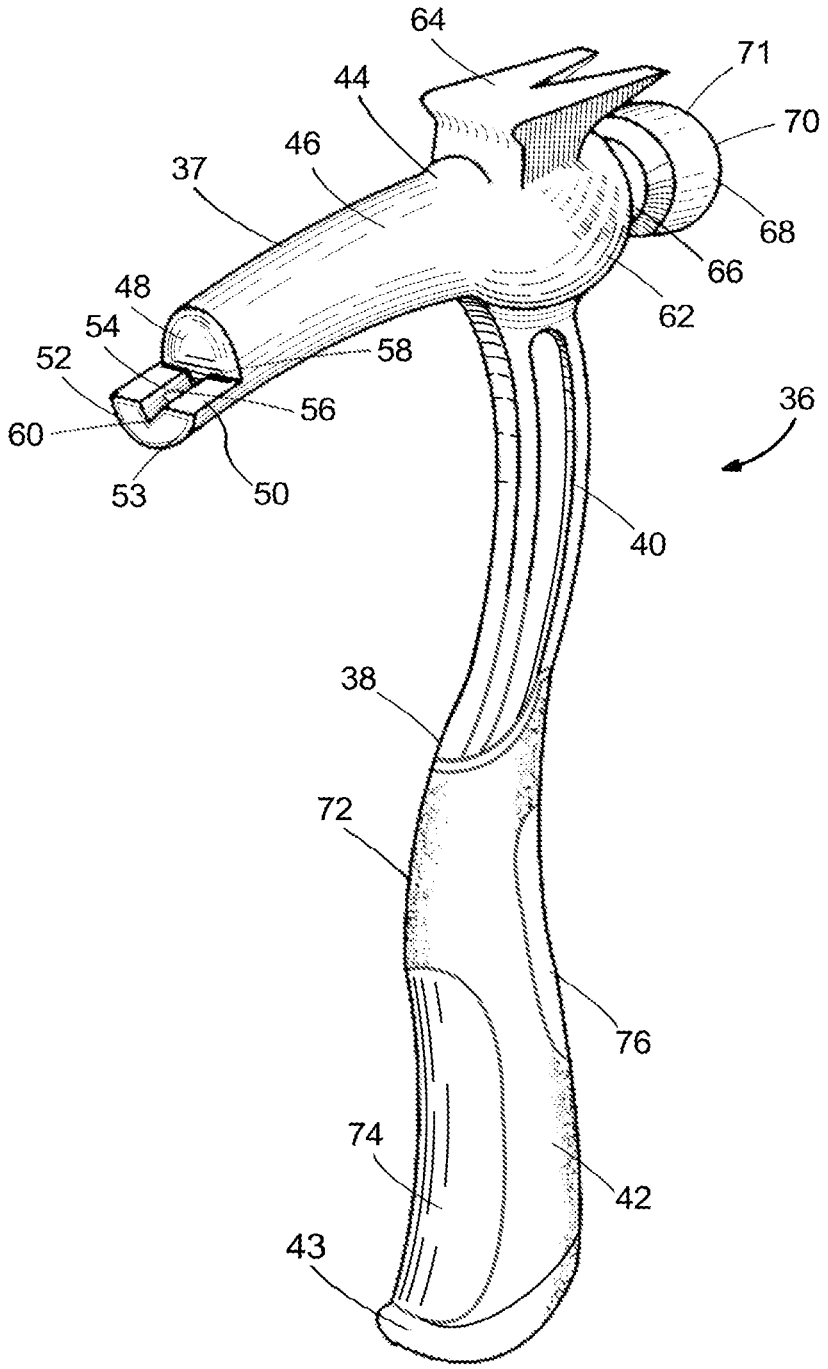
FIG. 1 is a perspective view of an integrally formed hammer in accordance with an embodiment of the present invention.

36—hammer
37—head
38—handle
40—upper handle portion
42—lower handle portion
43—butt-end portion
46—nail-starter strike face neck
48—nail-starter strike face
50—horizontal cylinder segment
52—horizontal cylinder segment strike-face
53—horizontal cylinder segment chamfer
54—magnet
56—magnet opening
58—semi-circular nail head opening
60—v-shaped nail shaft groove
62—head body
64—claw nail remover
66—bell neck
68—bell
70—bell strike face
71—bell chamfer
72—lower handle covering

74—front finger grip area
76—rear finger grip area
78—nail

BRIEF DESCRIPTION OF THE INVENTION

One embodiment of the present invention consists of a curved head 37 disposed on the upper handle portion 40 of a curved handle 38. The curved nail-starter strike face neck 46 tapers so as to be reducing in diameter as it extends away from the center weight area of the head 37 and towards the nail-starter strike face 48. Said curved neck then extends further as a horizontal cylinder segment 50. In this segment a v-shaped nail shaft groove 60 with a recessed magnet 54 retains the nail while it is transported to the work piece surface in a typical manual nailing action.

DETAILED DESCRIPTION OF THE INVENTION

Figure 2:
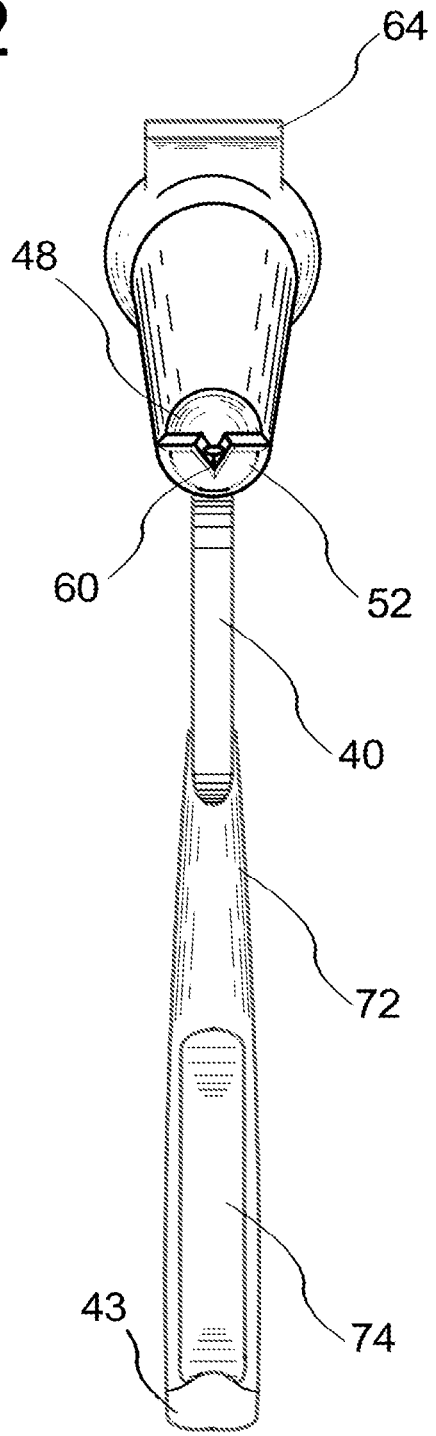
FIG. 2 is a front elevational view of the integrally formed hammer in accordance with an embodiment of the present invention.
Figure 3:
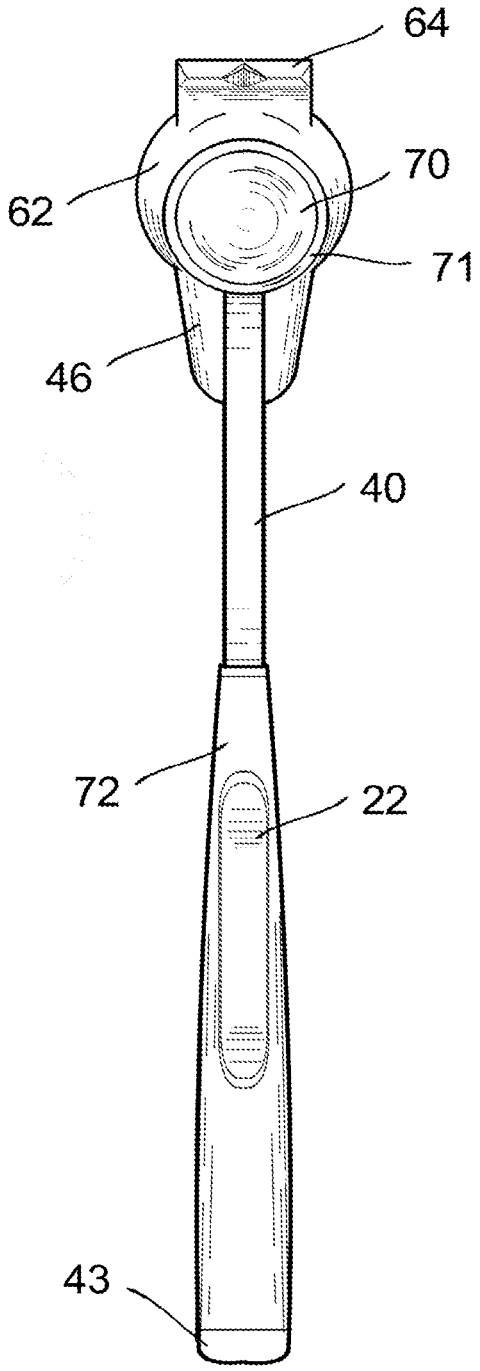
FIG. 3 is a rear elevational view of the integrally formed hammer in accordance with an embodiment of the present invention.

FIGS. 1, 2 and 3 show a hammer 36 in accordance with an embodiment of the present invention. The hammer 36 includes a handle 38 and a head 37. The handle 38 includes a lower portion 42 and an upper portion 40. The head 37 is disposed on the upper portion 40 of the handle 38. The head 37 includes two striking surfaces 48 and 52 disposed at one end of the nail-starter strike face neck 46 and a bell neck 66 and bell strike face 70 disposed on the adjacent end.

Figure 4:
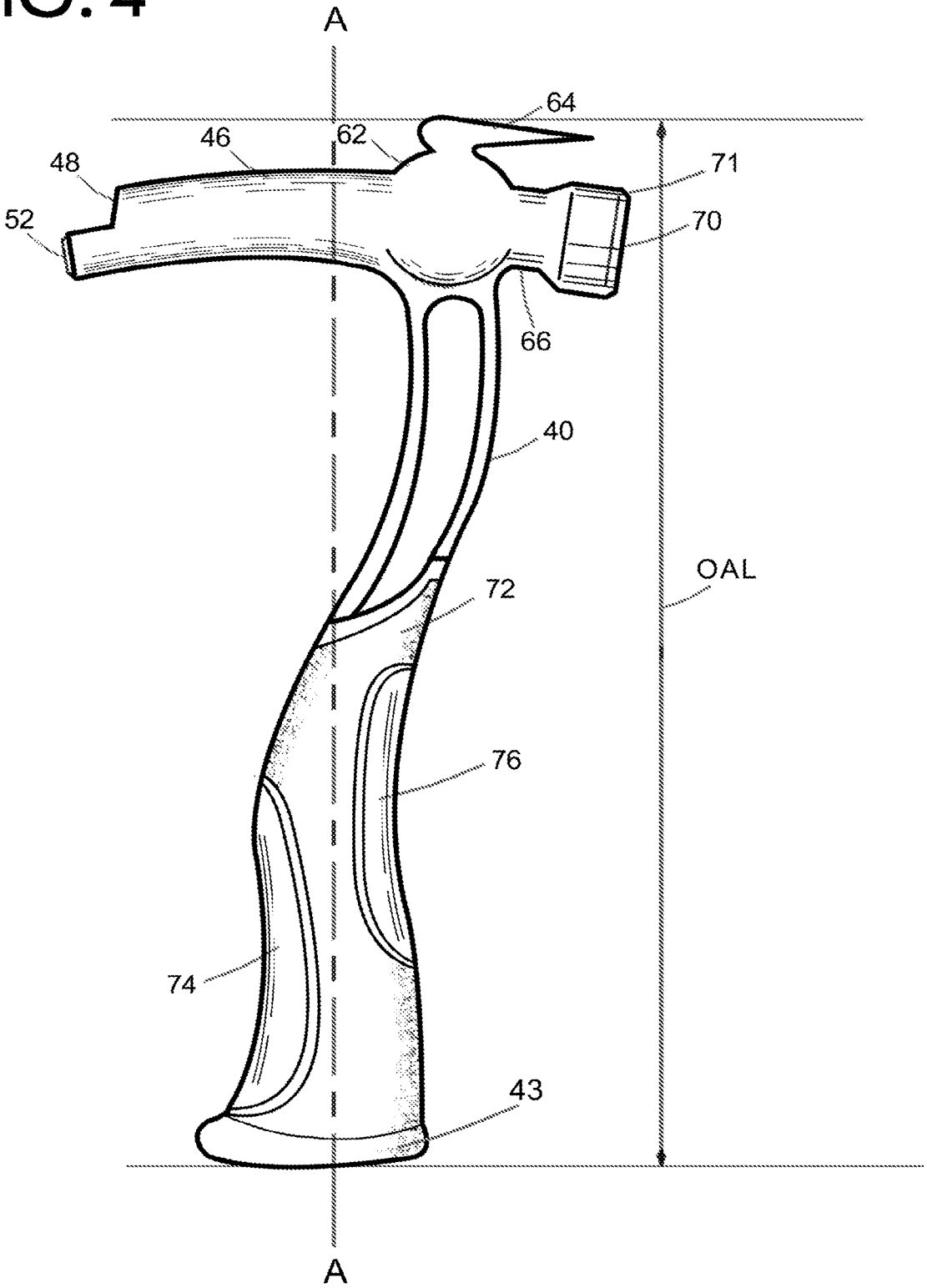
FIG. 4 is a left hand side elevational view of the integrally formed hammer in accordance with an embodiment of the present invention.
Figure 5:
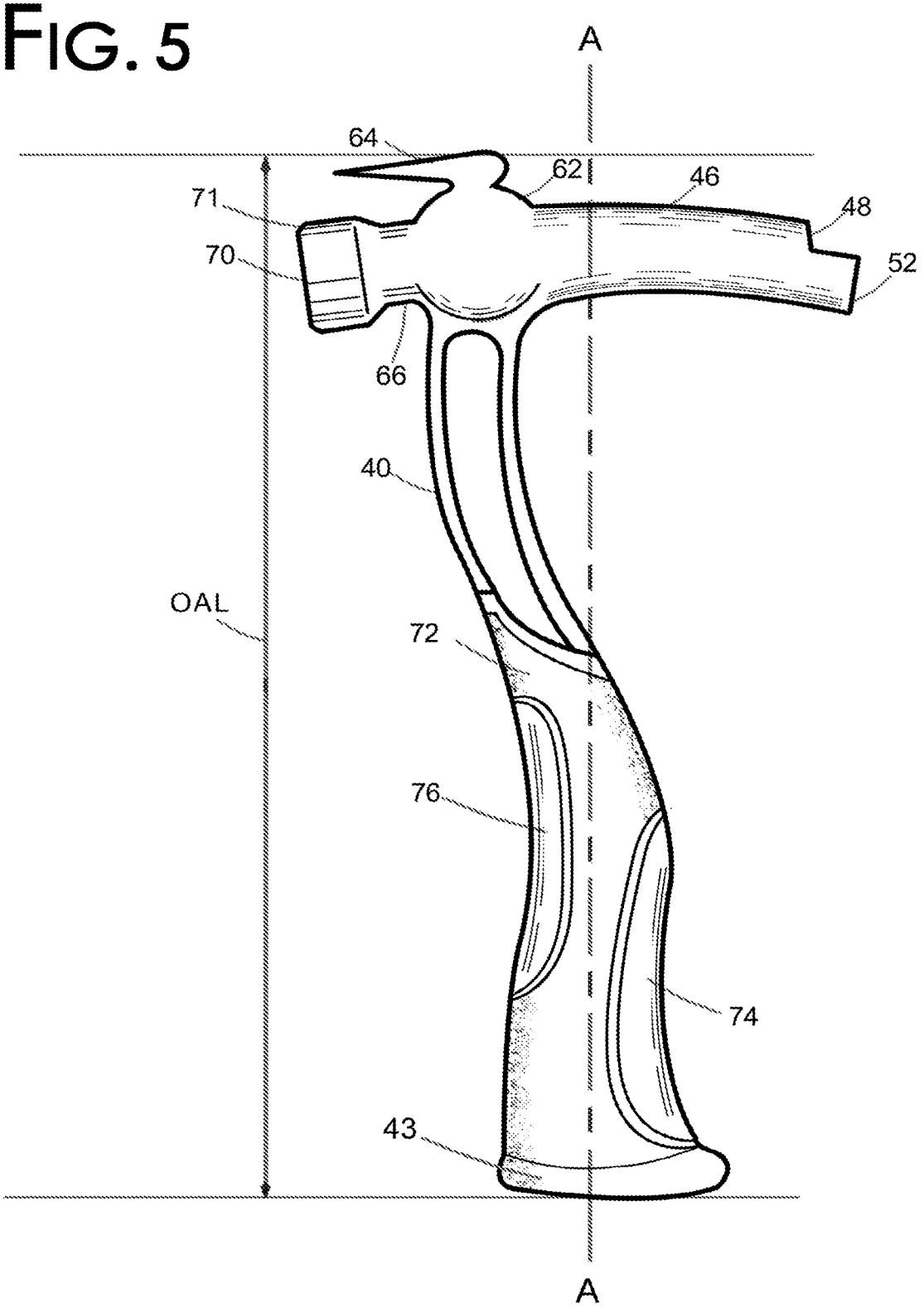
FIG. 5 is a right hand side elevational view of the integrally formed hammer in accordance with an embodiment of the present invention.

The hammer 36 includes the overall length dimension (OAL). In one embodiment, as shown in FIGS. 4 and 5, the overall length dimension (OAL) of the hammer 36 is measured along (or relative to) a central vertical axis A-A of the hammer 36. The (OAL) of one embodiment of the present invention as measured along the axis A-A is preferably 38-45 cm (15-18 inches).

Figure 6:
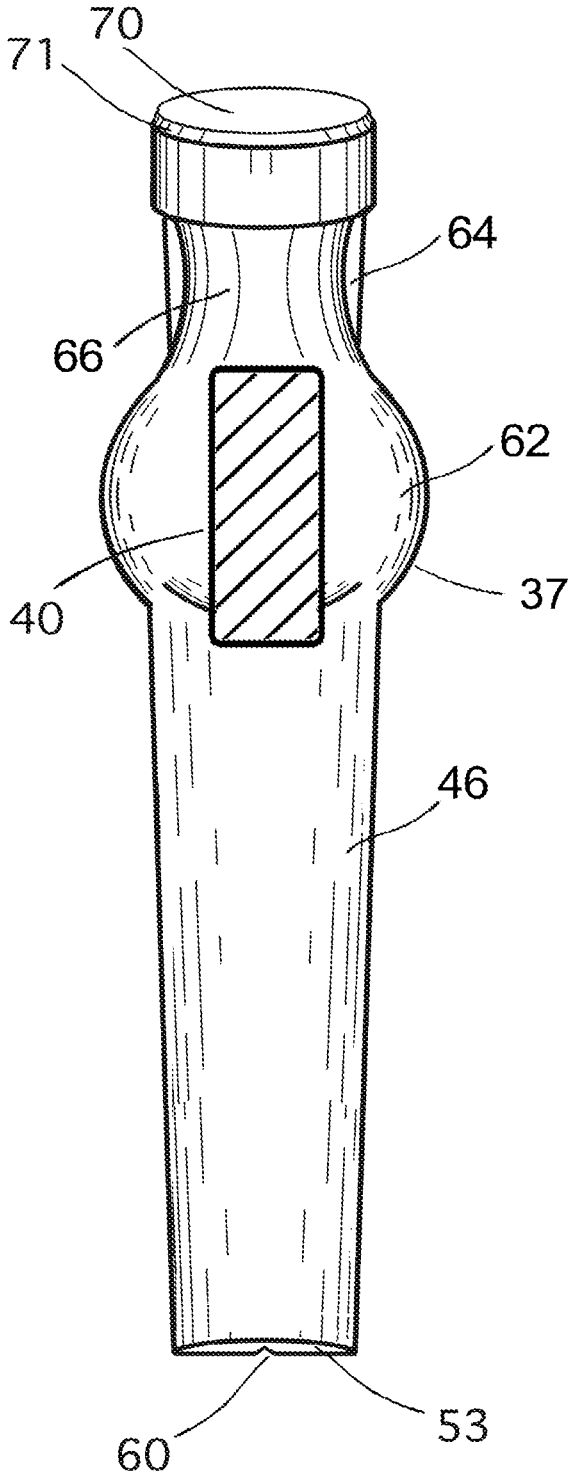
FIG. 6 is a bottom plan view of the integrally formed hammer head in accordance with an embodiment of the present invention.
Figure 7:
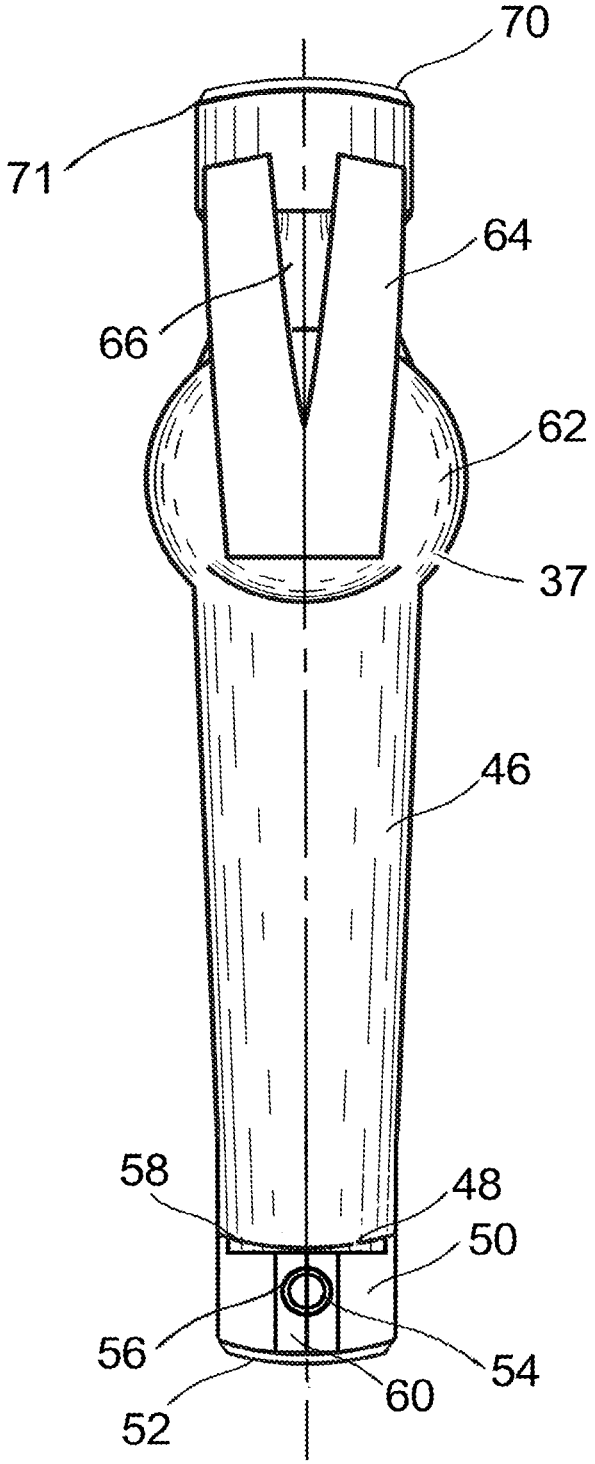
FIG. 7 is a top plan view of the integrally formed hammer head in accordance with an embodiment of the present invention.
Figure 14:
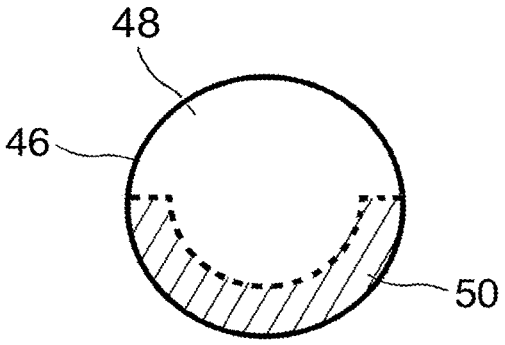
FIG. 14 is a sectional view thereof along the line D-D of FIG. 10 in accordance with an embodiment of the present invention.

In one embodiment, as shown in FIGS. 6 and 7 the head 37 is configured with a curved nail-starter strike face neck 46 tapering so as to be reducing in diameter as it extends away from the center weight area of the head 37 and towards the nail-starter strike face 48. The head 37 is generally curved whereby the horizontal center axis aligns with a typical arcing swing plane of the user when driving a nail into a work piece. The nail-starter strike face 48 diameter, as shown in FIG. 14 with a sectional view taken along the line D-D of FIG. 10, to head body 62 diameter is configured with a ratio of 1:2.2.

In one embodiment, the head 37 of the hammer 36 is integrally formed with the upper handle portion 40, as shown in FIGS. 1-5. The integrally formed handle 38 is made of metal, a composite material, or a synthetic material. In another embodiment, the head 37 and the handle 38 are formed separately and then connected to one another. Any suitable manner of connecting the head 37 and handle 38 may be employed. In this embodiment, the handle 38 shaft can be made from a different material than the head 37, such as wood, aluminum, a plastic material, a fiberglass material, or other suitable material.

As shown in FIGS. 1-5, the hammer 36 includes a manually engageable lower handle covering 72. In one embodiment, the lower handle covering 72 is simply the outer surface of the handle material (e.g., wood or metal). In another embodiment, the manually engageable lower handle covering 72 of the hammer 36 is molded onto an inner or core portion of the lower handle portion 40. In one embodiment, the lower handle covering 72 is made of a rubber based material, a plastic based material or other suitable material. Optionally, the lower handle covering 72 can be ergonomically shaped. For example, a plurality of ridges spaced longitudinally along the front finger grip area 74 and the rear finger grip area 76. As shown in FIGS. 1-5, the lower handle covering 72 ergonomically includes an extended toe on the front facing edge of a butt-end portion 43.

The upper handle portion 40 is configured likewise to provide durability and/or strength. It is configured with an I-shape cross sectional profile to provide a beneficial distribution of mass. The I-shape cross-sectional profile includes front and rear flanges and connecting web. Front flange preferably provides a broad surface adapted to reduce damage to handle 38 and/or a target caused by striking contact there-between, such as due to an overstrike. Web preferably resists bending and provides strength for handle 38 to allow generation and delivery of substantial striking forces by striking surface.

Yet another embodiment would configure the head body 62 in an increased aerodynamic, non-spherical shape, whereby the generally curving and tapered nail-starter strike face neck 46 transverses the bilateral axis of the head 37 and upper handle portion 40 and thereby extends as the bell neck of the adjacent strike face bell.

Figure 8:
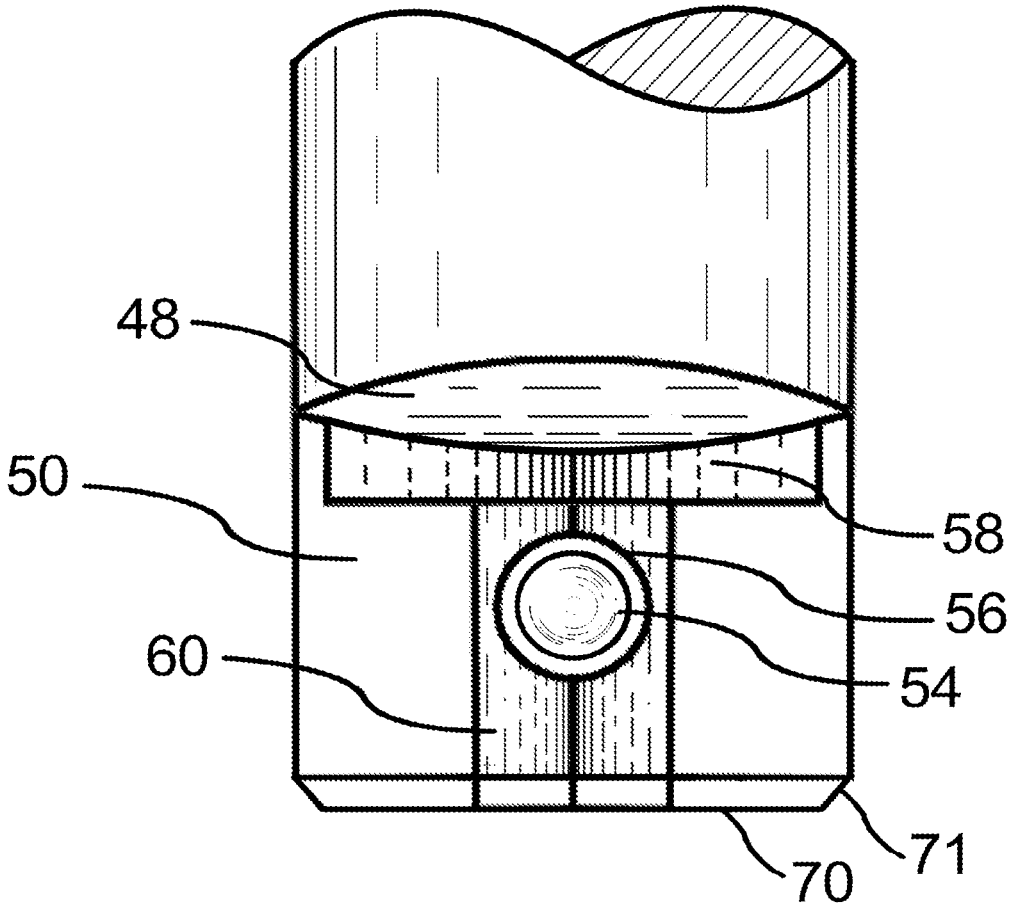
FIG. 8 is a partial top plan view of the nail-starter strike face and nail groove platform in accordance with an embodiment of the present invention.
Figure 9:
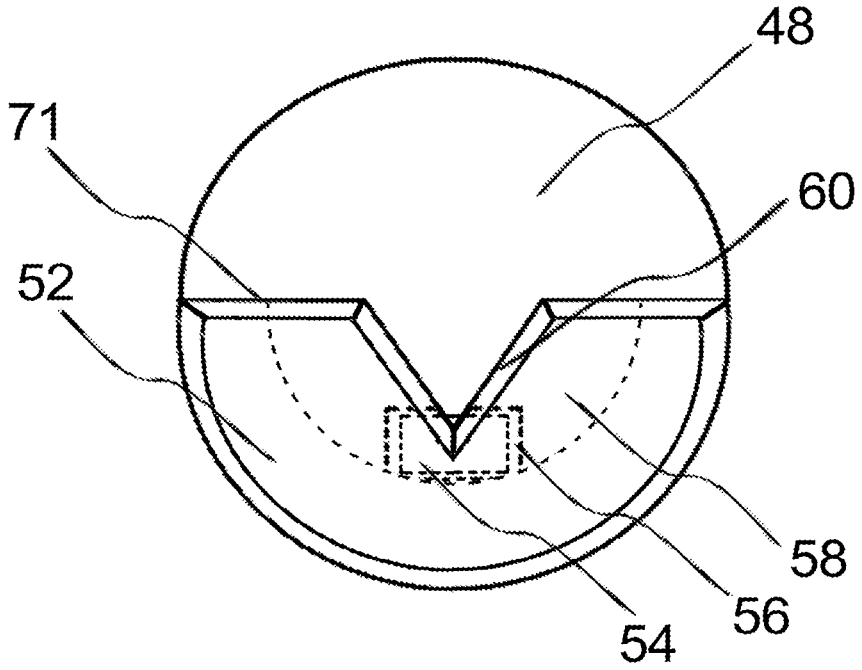
FIG. 9 is a partial front view of the nail-starter strike face and nail groove platform in accordance with an embodiment of the present invention.
Figure 10:
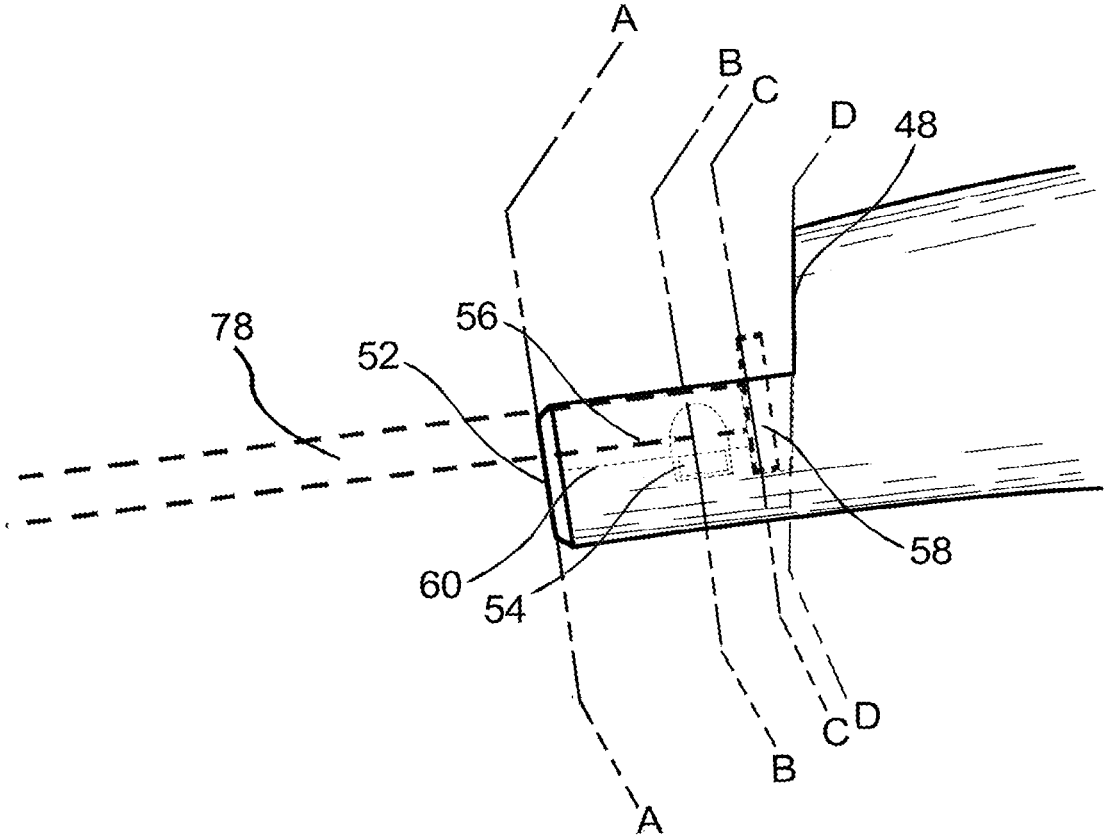
FIG. 10 is a partial left hand side elevational view of the integrally formed hammer illustrating different cross-sections of the nail groove platform and nail-starter strike face therethrough in accordance with an embodiment of the present invention.

As shown in the partial views of FIGS. 8-10, a grooved horizontal cylinder segment 50 extends from the lower portion of the nail-starter strike face neck 46. FIG. 8 shows a magnet 54 is located in the opening 56 of the v-shaped nail shaft groove 60. The magnet opening is 5 mm (3/16 in.) in diameter and with the perimeter disposed 2 mm (1/16 in.) from the front wall of the semi-circular nail head opening 58. The groove 60 is constructed and arranged to receive and retain a nail 78, (shown in dashed lines in FIG. 10), therein when the nail 78 is disposed in an initial nail driving position to facilitate the start of a nail driving operation.

Also shown in FIGS. 8-10, is a semi-circular nail head opening 58 disposed between the v-groove 60 and the nail-starter strike face 48. Said opening is constructed and arranged to provide open space for the head of a nail 78. Thus, the v-groove 60 and the magnet 54, combined with the force and momentum of the hammer 36, act together to position and to initially connect the nail 78 with a work piece. The nail-starter strike face 48 is constructed and arranged at an angle of 81 degrees in relation to the v-groove longitudinal axis. The width of the nail head opening 58 as measured along the longitudinal center axis of the neck is 4 mm (1/8 in.).

FIG. 10 shows a partial left hand side elevational view of the nail-starter strike face neck 46 and horizontal cylinder segment 50 of the hammer 36 illustrating different cross-sections being taken therethrough in accordance with an embodiment of the present invention.

Figure 10A:
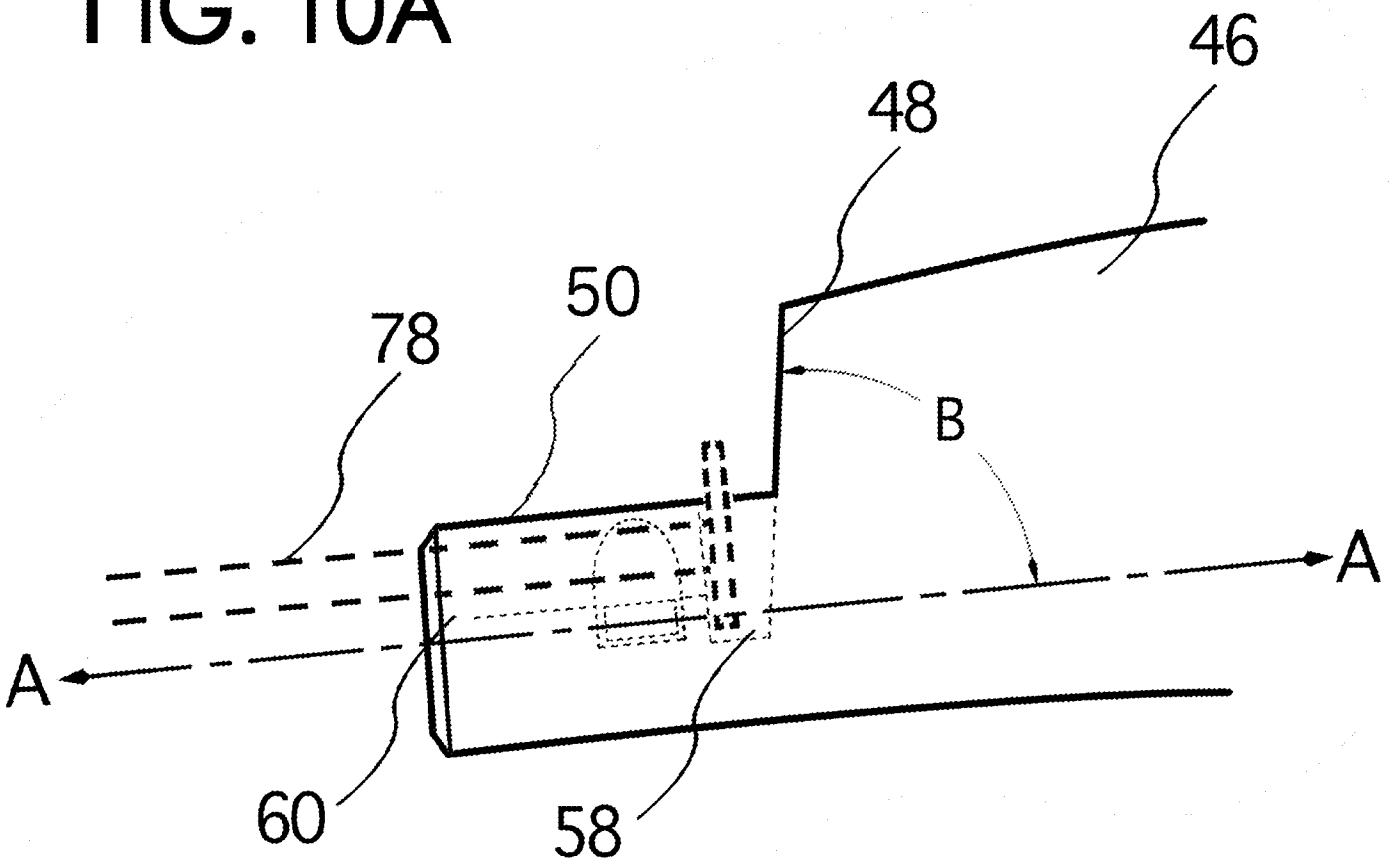
FIG. 10A is a partial left hand side elevational view of the integrally formed hammer illustrating nail-starter strike face angle.

FIG. 10A shows a partial left hand side elevational view of the nail-starter strike face neck 46 and horizontal cylinder segment 50 of the hammer 36 whereby B represents a nail-starter strike face 48 angle of 81 degrees relative to the horizontal cylinder segment center line marked as A-A.

FIGS. 11-14 show progressive cross-sectional views of the horizontal cylinder segment 50 and the v-shaped nail shaft groove 60 of the hammer 36 taken along various sections of FIG. 10 (eg., at lines A-A through D-D) moving from the horizontal cylinder segment strike-face 52 of the head 37 to the nail-starter strike face 48 (as shown in FIG. 10) of the head 37 of the hammer 36.

Figure 11:
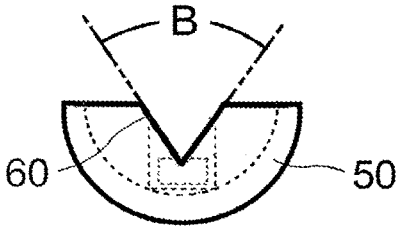
FIG. 11 is a sectional view thereof along the line A-A of FIG. 10 in accordance with an embodiment of the present invention.

FIG. 11 shows a cross-sectional view of the head 37 of the integrally formed hammer 36 taken along the line A-A of FIG. 10. It shows the leading edge of the horizontal cylinder segment strike-face 52 and the angles of the v-shaped nail shaft groove 60 walls. In this diagram B represents 60 degrees.

Figure 12:
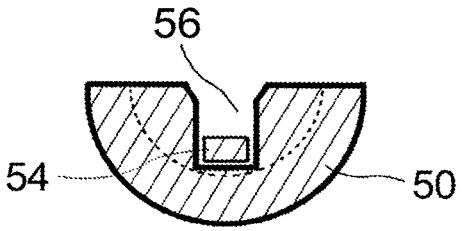
FIG. 12 is a sectional view thereof along the line B-B of FIG. 10 in accordance with an embodiment of the present invention.

FIG. 12 shows a cross-sectional view of the head 37 of the integrally formed hammer 36 taken along the line B-B of FIG. 10. The opening 56 for receiving the magnet 54 is shown in the cross-sectional view.

Figure 13:
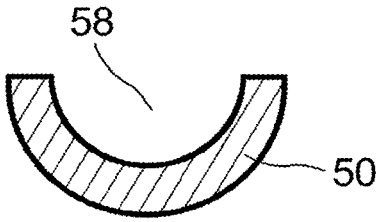
FIG. 13 is a sectional view thereof along the line C-C of FIG. 10 in accordance with an embodiment of the present invention.

FIG. 13 shows a cross-sectional view of the head 37 of the integrally formed hammer 36 taken along the line C-C of FIG. 10. The semi-circular nail head opening 58 for receiving the nail head is shown in the cross-sectional view. The hatched area indicates a cross-sectional view of the horizontal cylinder segment as it forms the perimeter of the nail head opening.

FIG. 14 shows a cross-sectional view of the head 37 of the integrally formed hammer 36 taken at an 81 degree angle in relation to the horizontal axis of the v-shaped nail shaft groove 60 along the line D-D of FIG. 10. The leading edge of the nail-starter strike face 48 in relation to the hatched area indicating the connection between nail-starter strike face neck 46 and the horizontal cylinder segment 50.

Figure 15:
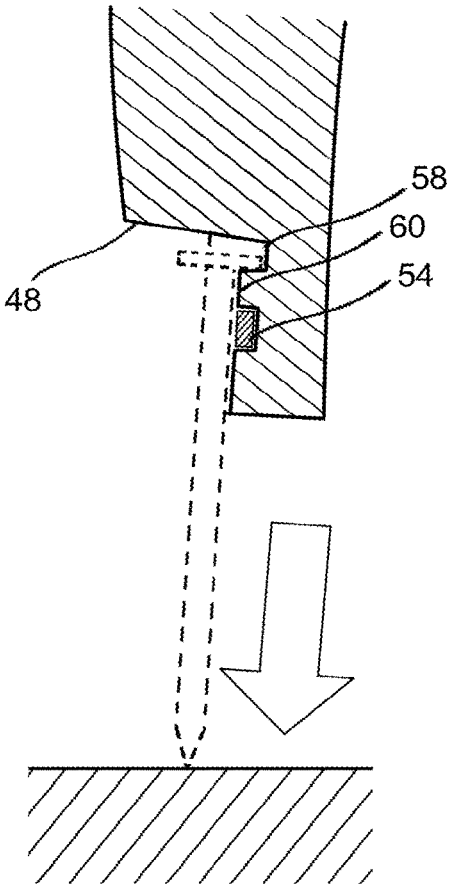
FIG. 15 is a partial left hand side sectional view of the nail-starter strike face and horizontal cylinder segment with a nail disposed therein to demonstrate the use of the integrally formed hammer in accordance with an embodiment of the present invention.
Figure 16:
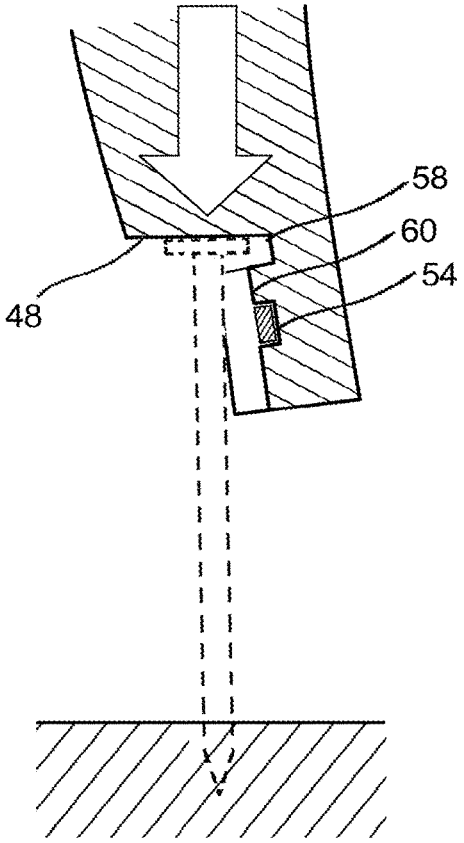
FIG. 16 is a partial left hand side sectional view of the nail-starter strike face and horizontal cylinder segment with a nail head against the nail-starter strike face to demonstrate the use of the integrally formed hammer in accordance with an embodiment of the present invention.

FIG. 15 shows how the nail starter and nail starter strike face function together. Initial contact with the work piece surface is made by the nail point. This contact between the nail point and the inert mass of the work piece slows the nail movement. The nail point is therein connected to, and in that manner, part of the work piece. Kinetic energy from said contact is minimal and dissipates quickly. The hammer 36 continues toward the work piece so as to cause the nail shaft to transverse laterally along the v-groove 60 toward the nail-starter strike face 48. Hence the nail head is thereby impacted by the nail-starter strike face 48. This impact against the lower region of the nail head applies force against the upper portion of the nail shaft, thereby causing it to move out from the v-groove 60 and disconnect from the magnetic field of the magnet 54. Hence, shifting of the nail head on the nail-starter strike face 48, as shown in FIG. 16, aligns the nail shaft to be perpendicular to the nail-starter strike face. Said alignment thereby allows for the direct transference of kinetic energy from the weight and momentum of the head and all other connected mass to drive the nail shaft, which is already connected to, and therefore part of, the work piece, deeper into the work piece. Said transference of energy becomes more like a traditional hammer strike on a nail head. The magnet 54 and the nail shaft support 60 perform the task of a nail starter and the nail-starter strike face 48 acts as the main strike force applied to the nail head and shaft.

Figure 17:
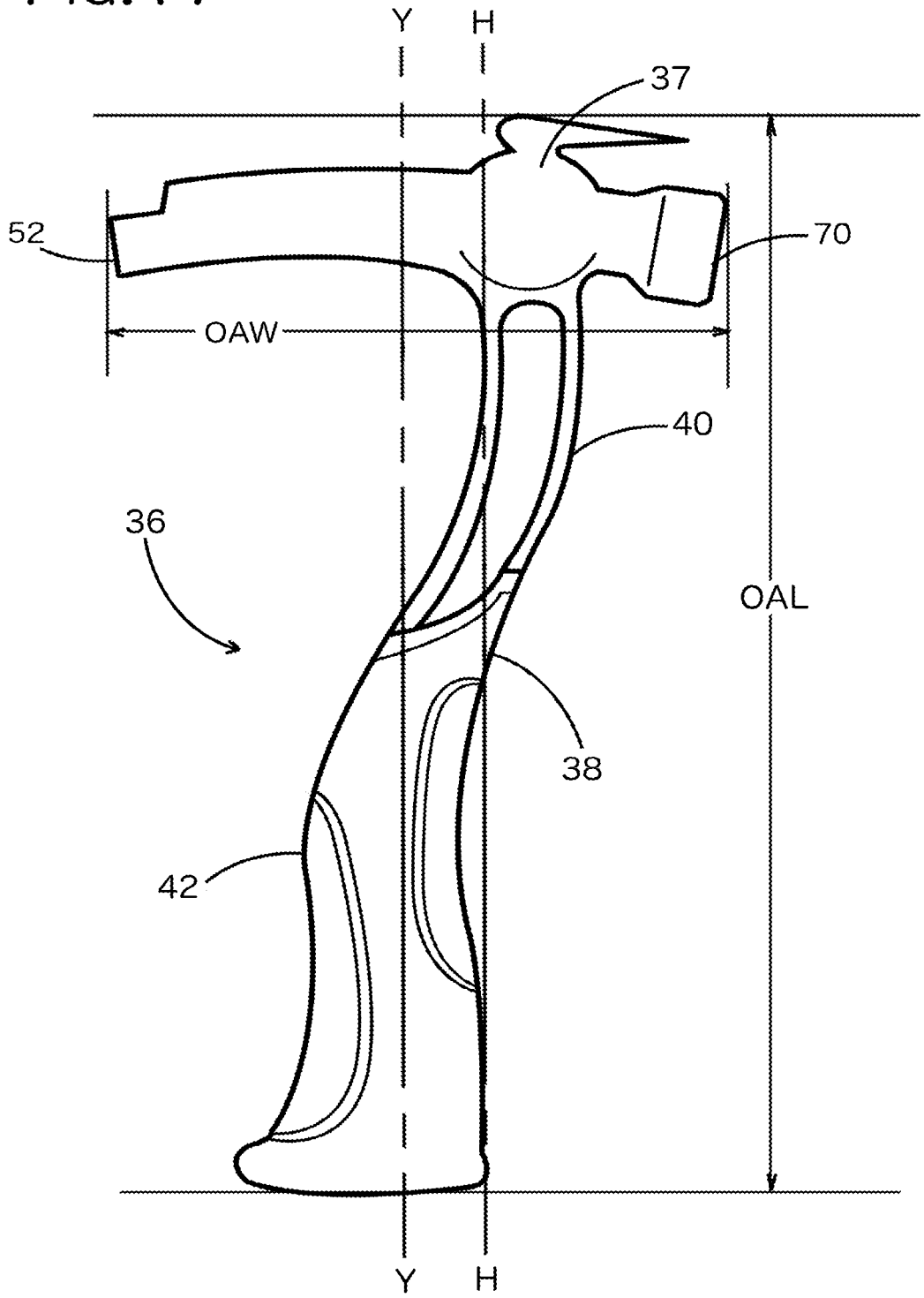
FIG. 17 is a left hand side elevational view to illustrate strike face angles and center axis weight distribution of the integrally formed hammer in accordance with an embodiment of the present invention.

FIG. 17 shows a left profile view of the integrally formed hammer 36 in accordance with an embodiment of the present invention. In non-limiting examples, the weight of the integrally formed head 37 is nominally between 510 and 907 grams (18 and 32 ounces); and the overall length dimension (OAL) of the integrally formed hammer 36 is between 38 and 45 cm (15 and 18 inches). In one embodiment, the handle 38 and the head 37 of the hammer 36 are made from steel material.

FIG. 17 also shows the head 37 of this embodiment is disposed back from the center of balance, indicated by the bisecting broken line of Y-Y. Said position of the head 37 behind the center axis allows for a greater draw-back distance between nail point and strike surface when the hammer 36 is used in a typical arcing motion. In this configuration the upper handle portion 40 curves generally back from the axis of center balance, defined by the vertical broken line marked Y-Y until the leading edge of the upper handle portion 40 vertically aligns with the rear edge of the lower handle portion 42. This alignment is indicated in by the broken line marked H-H.

Also shown in FIG. 17, indicated by the broken line marked U, is the distance between the nail-starter strike face 48 and the bell strike face 70. For the purpose of OAL, measurement of said U shall represent head 37 length. The ratio of U to handle length in this embodiment of the present invention is 1:2.25

FIG. 17 further indicates the angles of head 37 strike faces in relation to the handle 38 center of balance as defined by the vertical broken line marked Y-Y. The bell strike face 70 angle, indicated as S, is configured at 81 degrees relative to the broken vertical line marked Y-Y. The horizontal cylinder segment strike-face 52 angle, indicated as R, is configured at 99 degrees relative to the broken vertical line marked Y-Y.

Figure 18:
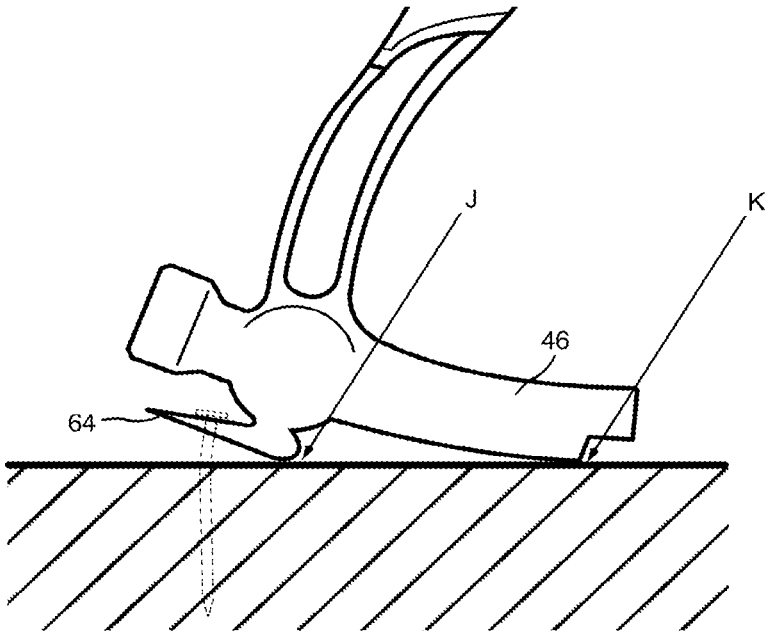
FIG. 18 is a partial left hand side view with nail head engaged by hammer claw to demonstrate the use of a secondary leverage point of the integrally formed hammer in accordance with an embodiment of the present invention.
Figure 18A:
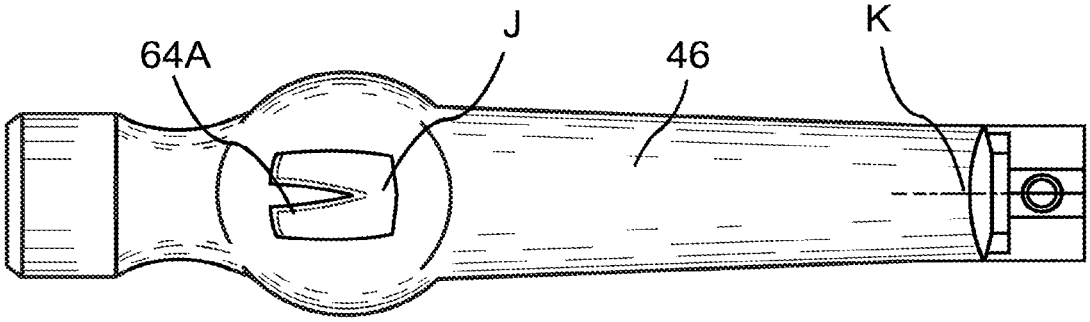
FIG. 18A is a top plan view of another embodiment with reduced bifurcated claws configured so as to primarily utilize an alternate leverage point.

FIG. 18 shows a bifurcated claw nail remover 64 centrally located on top of the head body 62 of one embodiment provides and leverage point, indicated with an arrow as J in conventional use pulling nails. During a nail pulling operation the top edge of the nail-starter strike face neck 46 provides for a second leverage point, shown in FIG. 18 as point K, for use with said bifurcated claw. This function could be enhanced by reducing the overall size of the bifurcated claw as shown in FIG. 18A.

Figure 19:
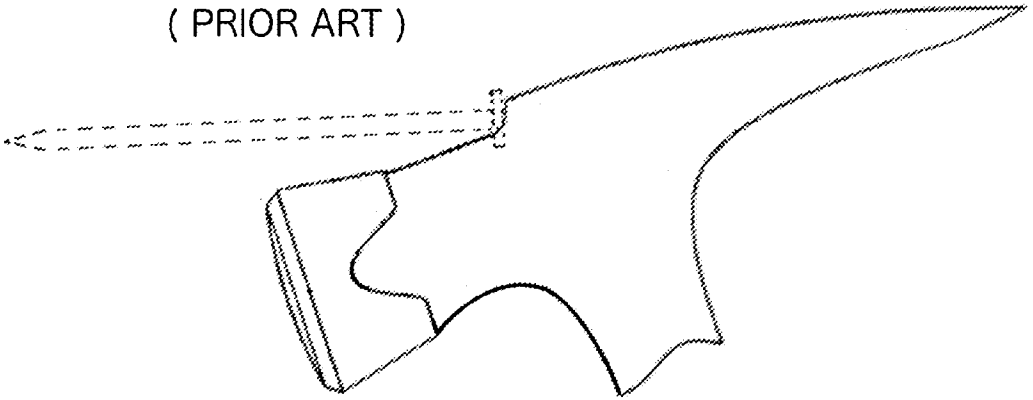
FIG. 19 ( PRIOR ART )
FIG. 19 is a left hand side view of prior art that shows a typical configuration of mass and the positioning of nail and nail starter during the striking action.

FIG. 19 shows the typical prior art configuration of a nail starting hammer. Illustrated is the position of greatest nail impact force. A minimal amount of weight and mass is directed to a portion of the nail head with a glancing blow before it loses contact with the strike face.

Figure 20:
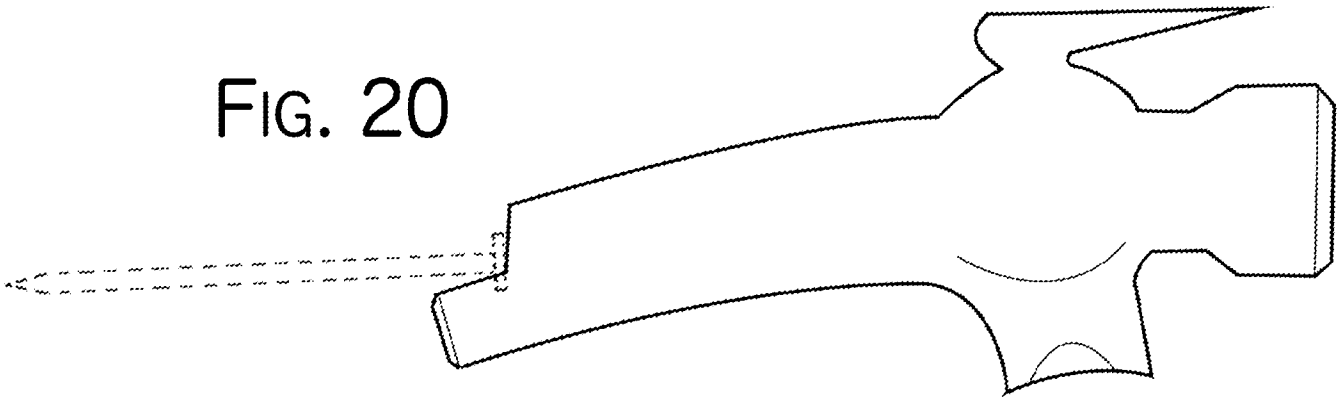
FIG. 20 is a left hand side view that shows a preferred configuration of mass and the positioning of nail and nail starter strike face during the striking action.

FIG. 20 shows an embodiment of the present invention to illustrate the configuration of mass and positioning of nail starter strike face in relation to nail head. Illustrated is the position of greatest nail impact force. A substantial amount of weight and mass is directed to the entire nail head and sustains contact for the complete action of driving the nail substantially into the work piece.

While these descriptions contain many specificities, they should not be construed as limitations on the scope, but rather as an exemplification of one (or several) embodiment (s) thereof. Many other variations are possible.

Other Advantages of the Invention

Nail insertion depth is determined by the distance the horizontal cylinder segment 50 extends outward from the nail-starter strike face 48. In some instances it is beneficial to predetermine the depth to which nails are implanted into the work piece. Hence the horizontal cylinder segment 50 may be configured for alternate nail starter depths.

Another advantage of this embodiment of the present invention is the reduction of torque and vibration effects experienced by the user. Common hammer handles have a tendency to transfer torque (the twisting across the longitudinal axis of the handle) and kinetic energy to a user's hand when a work piece is impacted. In order to maintain force direction and tool positioning, the user grips the handle more firmly while impacting the work piece. This embodiment of the present invention allows the user to do the opposite. Once the vertical descent motion has been initiated the user can loosen their grip on the handle 38 and allow the head 37 to implant the nail while only minimally maintaining contact with the handle 38 so as to guide it. The proximity of nail-starter strike face 48 to nail head thereby transfers less vibration and spread of kinetic energy.

Summation

Among various other advantages this tested embodiment of the present invention surpasses many objectives of prior art nailing hammer and nail-starter hammers. It places a nail deeper into a work piece with the first strike. It also places the nail more consistently and reliably with fewer strikes, and is capable of placing the nail to a predetermined depth with one strike.

What is claimed is:

1. A hammer (36) comprising:

a handle (38), the handle having an upper handle portion (40), and a lower handle portion (42): and a head (37) disposed on the upper handle portion (40);

the head (37) having a centrally configured head body (62) that is integrally formed with the upper handle portion, wherein the head (37) is comprised of a curved and tapering nail-starter strike face neck (46) of a predetermined length, wherein the nail-starter strike face neck has a nail-starter strike face (48), configured at a predetermined angle and the lower portion of the nail-starter strike face neck (46) further extends as a horizontal cylinder segment (50), wherein is configured a groove and magnet (54) to arrange and affix a nail thereon, a semi-circular nail head opening (58) comprising a shoulder and configured to receive the nail head in a position between the shoulder and the nail-starter strike face (48), and wherein the horizontal cylinder segment (50) includes a convex strike face (52) in both horizontal and vertical directions, characterized in that a chamfer (53) is disposed along the edges of the strike face (52); and wherein the adjacent end of the hammer (36) head (37) is configured with a bell neck (66) and bell (68), wherein the bell (68) includes a convex bell strike surface (70) in both horizontal and vertical directions, characterized in that a chamfer (71) is disposed along the edges of the strike face;

and a bifurcated claw nail remover (64) disposed on top of the head (37).

2. The hammer (36) of claim 1, wherein the nail-starter strike face neck (46) tapers at a reducing diameter as it extends away from a center of the head body (62) and towards the nail-starter strike face (48).

3. The hammer (36) of any one of the preceding claims, wherein the nail-starter strike face is generally round shaped comprising a predetermined diameter and having the head disposed directly behind said nail-starter strike face.

4. The hammer (36) of claim 1, wherein the head (37) is laterally offset a predetermined distance (H) relative to a vertical center line (Y) of the lower handle portion (42).

5. The hammer (36) of claim 4, wherein the upper handle portion (40) is generally curved as it transverses upward to attach with a bottom center of the head (37).

6. The hammer (36) of claim 1, wherein the upper handle portion (40) comprises an I-shape cross-sectional profile having front and rear flanges, and a center web.

7. The hammer (36) of claim 1, wherein the nail-starter strike face is angled preferably between 75 and 85 degrees relative to a horizontal plane of the nail-starter strike face neck.

8. The hammer (36) of claim 1, wherein the handle (38) comprises a metal shaft and disposed with a covering of a different material on top of the metal shaft, and wherein the covering comprises at least one of indents, ridges and textures on a front and a rear surface of the covering.

9. The hammer (36) of claim 1, wherein the groove is a v-shaped nail shaft groove (60) comprising nail shaft support walls wherein the nail shaft support walls are angled to form a 60 degree vertical wedge.

* * * * *